US008415593B2

(12) United States Patent
Choi

(10) Patent No.: US 8,415,593 B2
(45) Date of Patent: Apr. 9, 2013

(54) MICRO-HEATERS AND METHODS OF MANUFACTURING THE SAME

(75) Inventor: Junhee Choi, Seongnam-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 1181 days.

(21) Appl. No.: 12/289,440

(22) Filed: Oct. 28, 2008

(65) Prior Publication Data

US 2009/0289049 A1 Nov. 26, 2009

(30) Foreign Application Priority Data

May 23, 2008 (KR) ..... 10-2008-0048308

(51) Int. Cl.
*H05B 3/10* (2006.01)
*H05B 3/16* (2006.01)
*H01C 3/08* (2006.01)

(52) U.S. Cl. ..... 219/552; 219/209; 219/538; 219/539; 338/114

(58) Field of Classification Search ..... None
See application file for complete search history.

(56) References Cited

U.S. PATENT DOCUMENTS

| | | | | |
|---|---|---|---|---|
| 3,745,508 | A | 7/1973 | Bruder et al. | |
| 4,374,312 | A | 2/1983 | Damron | |
| 4,478,077 | A * | 10/1984 | Bohrer et al. | 73/204.26 |
| 4,510,036 | A | 4/1985 | Takeuchi et al. | |
| 4,651,564 | A * | 3/1987 | Johnson et al. | 73/204.26 |
| 4,696,188 | A * | 9/1987 | Higashi | 73/204.19 |
| 5,288,973 | A | 2/1994 | Ota et al. | |
| 5,780,524 | A | 7/1998 | Olsen | |
| 6,091,050 | A | 7/2000 | Carr | |
| 6,331,074 | B1 * | 12/2001 | Kimura | 374/10 |
| 6,460,966 | B1 | 10/2002 | Hellekson et al. | |
| 6,705,152 | B2 | 3/2004 | Routkevitch et al. | |
| 6,896,780 | B2 | 5/2005 | Yang et al. | |
| 7,049,556 | B2 | 5/2006 | Aoki et al. | |
| 7,119,656 | B2 | 10/2006 | Landsberger et al. | |

(Continued)

FOREIGN PATENT DOCUMENTS

| | | |
|---|---|---|
| JP | 07-022315 | 1/1995 |
| JP | 2002-124466 | 4/2002 |

(Continued)

OTHER PUBLICATIONS

European Search Report, dated Sep. 16, 2011, for Application 08157114.3-1242/2066147.

(Continued)

*Primary Examiner* — Joseph M Pelham
(74) *Attorney, Agent, or Firm* — Harness, Dickey & Pierce, P.L.C.

(57) ABSTRACT

A micro-heater according to example embodiments may include a metal line formed on a substrate. A deforming portion may be integrally formed as part of the metal line. A support may be positioned between the metal line and the substrate. The support may secure the metal line to the substrate while spacing the metal line apart from the substrate. When the metal line is expanded or compressed by the heating or cooling that occurs during the operation of the micro-heater, the deforming portion of the metal line may deform so as to help absorb the resulting tensile stress. As a result, the amount of tensile stress experienced by the metal line may be decreased. Accordingly, the possibility of breakage of the metal line may be reduced or prevented.

20 Claims, 11 Drawing Sheets

U.S. PATENT DOCUMENTS

| | | | | |
|---|---|---|---|---|
| 7,329,361 | B2 | 2/2008 | Guha et al. | |
| 7,525,071 | B2 * | 4/2009 | Goto et al. | 219/543 |
| 7,533,564 | B2 | 5/2009 | Pan et al. | |
| 7,807,483 | B2 | 10/2010 | Yamazaki et al. | |
| 7,999,211 | B2 * | 8/2011 | Ruiz et al. | 219/539 |
| 2004/0178879 | A1 | 9/2004 | Mitra et al. | |
| 2006/0141135 | A1 | 6/2006 | Wang et al. | |
| 2007/0052024 | A1 | 3/2007 | Lee et al. | |
| 2009/0139974 | A1 * | 6/2009 | Choi et al. | 219/385 |
| 2009/0223557 | A1 * | 9/2009 | Park et al. | 136/255 |
| 2009/0250112 | A1 * | 10/2009 | Choi et al. | 136/259 |
| 2010/0187662 | A1 * | 7/2010 | Choi et al. | 257/656 |
| 2010/0193505 | A1 * | 8/2010 | Peck | 219/548 |
| 2012/0132643 | A1 * | 5/2012 | Choi et al. | 219/538 |

FOREIGN PATENT DOCUMENTS

| | | | |
|---|---|---|---|
| JP | 2004-087143 | | 3/2004 |
| JP | 2004-269968 | | 9/2004 |
| JP | 2005-150061 | | 6/2005 |
| JP | 2006-047276 | | 2/2006 |
| JP | 2006-286372 | | 10/2006 |
| JP | 2010278142 | A * | 12/2010 |
| KR | 10-2002-0090428 | | 12/2002 |
| KR | 20-0358225 | | 8/2004 |
| KR | 10-2004-0103726 | | 12/2004 |
| KR | 10-2006-0062139 | | 6/2006 |
| KR | 10-2006-0110201 | | 10/2006 |
| KR | 10-2007-0009804 | | 1/2007 |
| KR | 10-2009-0066644 | | 6/2009 |

OTHER PUBLICATIONS

S. Dittmer et al., *Low Ambient Temperature CVD Growth of Carbon Nanotubes*., 243-246 (2006).

Ongi Englander et al., *Local Synthesis of Silicon Nanowires and Carbon Nanotubes on Microbridges*., 4797-4799, (2003).

US Office Action dated Mar. 5, 2012 issued in co-pending U.S. Appl. No. 12/149,884.

US Office Action dated Mar. 16, 2012 issued in co-pending U.S. Appl. No. 12/289,439.

US Office Action dated Aug. 30, 2012 issued in co-pending U.S. Appl. No. 12/149,884.

US Office Action dated Sep. 24, 2012 issued in co-pending U.S. Appl. No. 13/452,105.

* cited by examiner

MICRO-HEATERS AND METHODS OF MANUFACTURING THE SAME

PRIORITY STATEMENT

This application claims priority under 35 U.S.C. §119 to Korean Patent Application No. 10-2008-0048308, filed on May 23, 2008 with the Korean Intellectual Property Office (KIPO), the entire contents of which are incorporated herein by reference.

BACKGROUND

1. Field

Example embodiments relate to micro-heaters and methods of manufacturing the same.

2. Discussion of Related Art

A conventional micro-heater generates high-temperature heat locally on a substrate by application of power. A conventional micro-heater may be applied to various types of electronic devices which require a high-temperature manufacturing process or a high-temperature operating process. Examples of such conventional electronic devices include a carbon nanotube transistor, a low-temperature polycrystalline silicon or thin film transistor, and a TE field emission source for a backlight unit.

In a conventional micro-heater, a heating element for heat generation and light emission is formed using a method including sputtering, e-beam evaporation, or the like. The materials in the resulting heating element have a columnar structure. However, when the micro-heater is heated, the materials in the heating element are re-crystallized. The recrystallized materials have a weaker solidity than those having a columnar structure.

When the heated micro-heater is cooled again, the length of the heating element of the micro-heater is decreased. Therefore, the heating element is subjected to tensile stress. As a result, the heating element may break, because the solidity of the materials has been weakened by the re-crystallization.

SUMMARY

A micro-heater according to example embodiments may include a primary metal line on a substrate, the primary metal line having a primary deforming portion integrally formed as part of the primary metal line. The primary deforming portion may have a structure that departs from and does not coincide with a longitudinal axis of the primary metal line. A primary support may be positioned between the primary metal line and the substrate, the primary support separating the primary metal line from the substrate while securing the primary metal line to the substrate.

The primary deforming portion may deform in response to an expansion or compression of the primary metal line. The primary deforming portion may adjoin or be spaced apart from a portion of the primary metal line that is connected to the primary support. The primary deforming portion may have a flat upper surface and a hollow center. The primary deforming portion may also have an open center. For instance, the primary deforming portion may have a circular shape or an elliptical shape. A major axis of the elliptical shape may be perpendicular to the longitudinal axis of the primary metal line. Alternatively, the primary deforming portion may have a curvilinear shape (e.g., semicircular shape, semi-elliptical shape) or a broken line shape (e.g., zigzag shape).

The micro-heater may further include a secondary metal line on the substrate that extends from a side of the primary metal line, the secondary metal line having a secondary deforming portion integrally formed as part of the secondary metal line. The secondary deforming portion may have a structure that departs from and does not coincide with a longitudinal axis of the secondary metal line. A secondary support may be disposed between the secondary metal line and the substrate, the secondary support separating the secondary metal line from the substrate while securing the secondary metal line to the substrate.

A micro-heater array may include two or more micro-heaters arranged in parallel on a substrate. An electronic device may include the aforementioned micro-heater or micro-heater array.

A method of manufacturing a micro-heater according to example embodiments may include forming a sacrificial layer on a substrate; forming a heating layer on the sacrificial layer; patterning the heating layer to form a heating line, the heating line having a deforming portion integrally formed as part of the heating line, the deforming portion having a structure that departs from and does not coincide with a longitudinal axis of the heating line; and/or etching the sacrificial layer to form a support between the heating line and the substrate, the support separating the heating line from the substrate while securing the heating line to the substrate.

BRIEF DESCRIPTION OF THE DRAWINGS

The various features of example embodiments may be better appreciated in view of the following detailed description in conjunction with the accompanying drawings, in which:

FIGS. 10A to 10C are views of a method of manufacturing a micro-heater according to example embodiments, wherein FIGS. 10A and 10C are cross-sectional views and FIG. 10B is a plan view.

Figure 1:
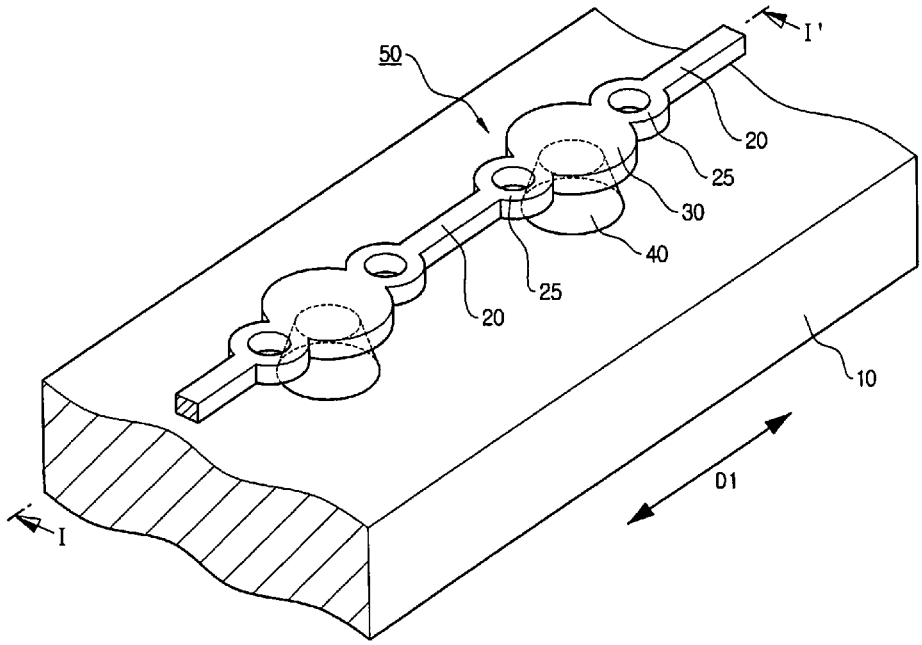
FIG. 1 is a perspective view of a micro-heater according to example embodiments.

It should be understood that the appended drawings are not necessarily to scale. Thus, the dimensions of various features illustrated in the drawings may have been exaggerated for purposes of clarity.

DETAILED DESCRIPTION OF EXAMPLE EMBODIMENTS

It will be understood that when an element or layer is referred to as being "on", "connected to", "coupled to", or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, e.g., "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 2:
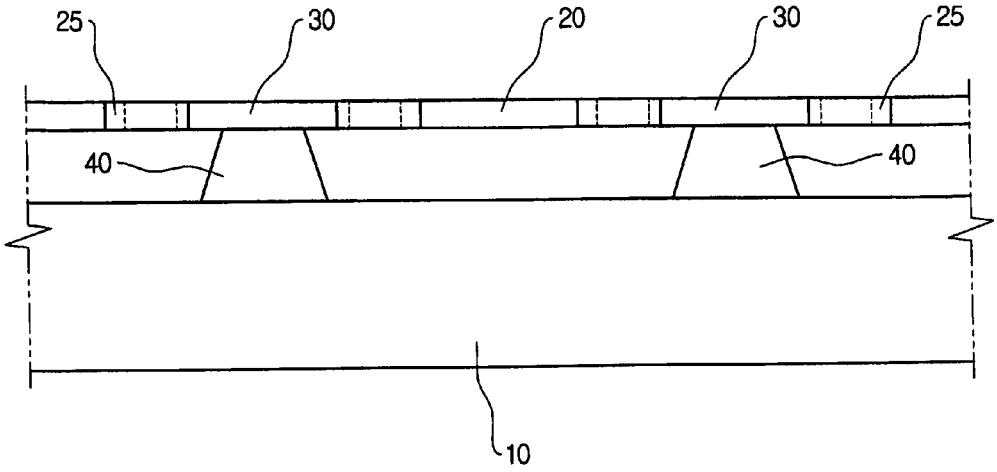
FIG. 2 is a cross-sectional view of FIG. 1, taken along line I-I'.

FIG. 1 is a perspective view of a micro-heater according to example embodiments. FIG. 2 is a cross-sectional view of FIG. 1, taken along line I-I'. Referring to FIGS. 1 and 2, the micro-heater 50 may be provided on a substrate 10. The micro-heater 50 may include a metal line 20 and a support 40. The metal line 20 may have a deforming portion 25.

The metal line 20 may extend along a linear direction D1 and may be positioned so as to be spaced apart from the substrate 10. The metal line 20 may be formed of at least one of molybdenum (Mo), tungsten (W), silicon carbide, or other suitable materials. Upon application of power, the metal line 20 may emit light and generate heat.

The substrate 10 may be formed of a silicon wafer or a glass material. When the substrate 10 is formed of a glass material, radiant heat (e.g., via visible light waves or infrared (IR) waves) may be transmitted through the substrate 10. As a result, heating at a relatively high temperature may be achieved.

The deforming portion 25 may be integrally formed as part of the metal line 20. The deforming portion 25 may have a structure that is deformable in response to tensile stress when the metal line 20 is expanded or compressed during the heating or cooling of the micro-heater 50.

The deforming portion 25 may be adjoined to a connecting portion 30 that is connected to the support 40. The deforming portion 25 may have a circular shape and a hollow, open center. When the metal line 20 is expanded or compressed, the shape of the deforming portion 25 will change so as to absorb the tensile stress caused by the expansion or compression. Accordingly, the metal line 20 may be subjected to less tensile stress, thus reducing or preventing the possibility of the metal line 20 being broken.

The deforming portion 25 may be formed of the same material as the metal line 20 and may be integrally formed with the metal line 20 through the same process. The metal line 20 may have a narrower width than the connecting portion 30 so as to decrease heat loss.

The support 40 may be provided between the substrate 10 and the metal line 20. The support 40 may be fixed to the substrate 10 and may support the metal line 20 while spacing the metal line 20 apart from the substrate 10 by a predetermined distance. The support 40 may be provided beneath the connecting portion 30 of the metal line 20 so as to partially contact the metal line 20. The support 40 may be formed such that the size of the bottom region contacting the substrate 10 may be greater than the size of the top region contacting the connecting portion 30.

Although the shape of the connecting portion 30 and the support 40 is illustrated as being circular, other shapes are possible. For example, the connecting portion 30 and the support 40 may resemble an ellipse, a semicircle, a semi-ellipse, a square, or other suitable shapes provided by conventional etching methods.

The support 40 may be formed of a material having a relatively low thermal conductivity so as to reduce or prevent the loss of heat generated by the metal line 20. For example, the support 40 may be formed of a silicon oxide ($SiO_x$) or other suitable oxide. As mentioned above, the connecting portion 30 may be supported by the support 40. As a result, the metal line 20 may be secured to the substrate 10 while also being spaced apart from the substrate 10 by the support 40.

When the metal line 20 is expanded or compressed as a result of the heating or cooling of the micro-heater 50, the shape of the deforming portion 25 will change in response to the resulting tensile stress. Consequently, the amount of tensile stress experienced by the metal line 20 may be decreased by the deformation of the deforming portion 25. Accordingly, it is possible to reduce or prevent the possibility of the metal line being broken when the micro-heater 50 is cooled even though the materials of the metal line 20 may have weaker solidity from the recrystallization that occurs during the heating of the micro-heater 50.

Figure 3:
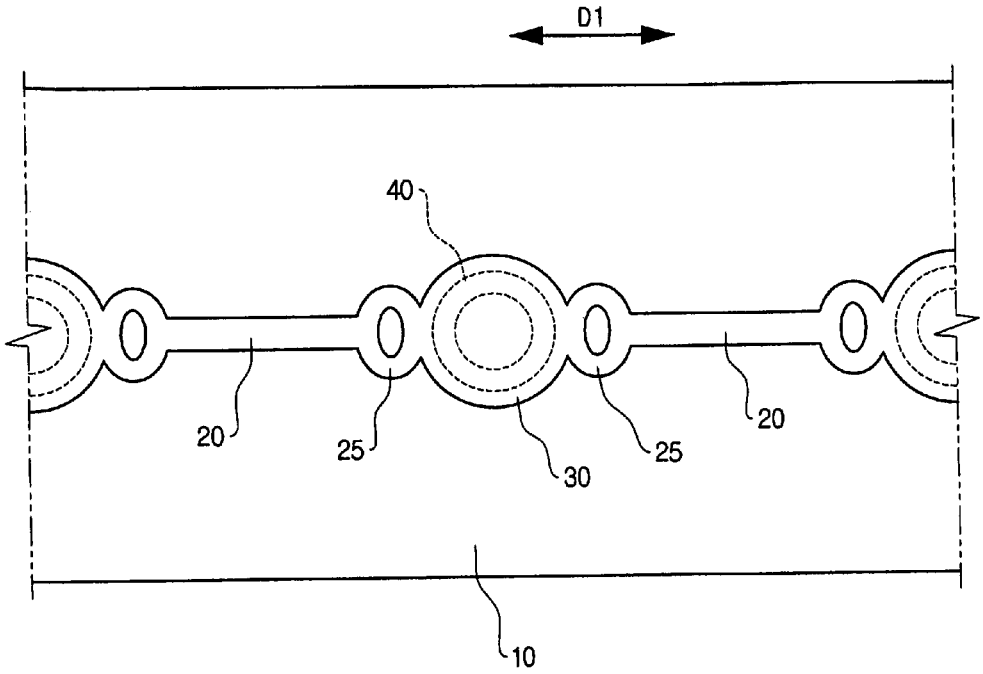
FIG. 3 is a plan view showing the deformation of the micro-heater of FIG. 1 when the micro-heater is heated.

FIG. 3 is a plan view showing the deformation of the micro-heater of FIG. 1 when the micro-heater is heated. When the micro-heater 50 is heated, the length of the metal line 20 may increase from the thermal expansion associated with increased temperature. The length of the metal line 20 may increase in all directions. Because the metal line 20 extends in one linear direction D1, the majority of the thermal expansion may occur along that direction. As described above, the heat may cause the materials of the metal line 20 to undergo re-crystallization.

The deforming portion 25 of the metal line 20 may be deformed by the tensile stress caused by the thermal expansion of the metal line 20. The connecting portion 30 of the metal line 20 may be fixed above the substrate 10 by the support 40. Thus, when the metal line 20 experiences thermal expansion, the deforming portion 25 may be compressed in the direction D1 and deformed from a circular shape to an elliptic shape having a major axis perpendicular to the direction D1.

Figure 4:
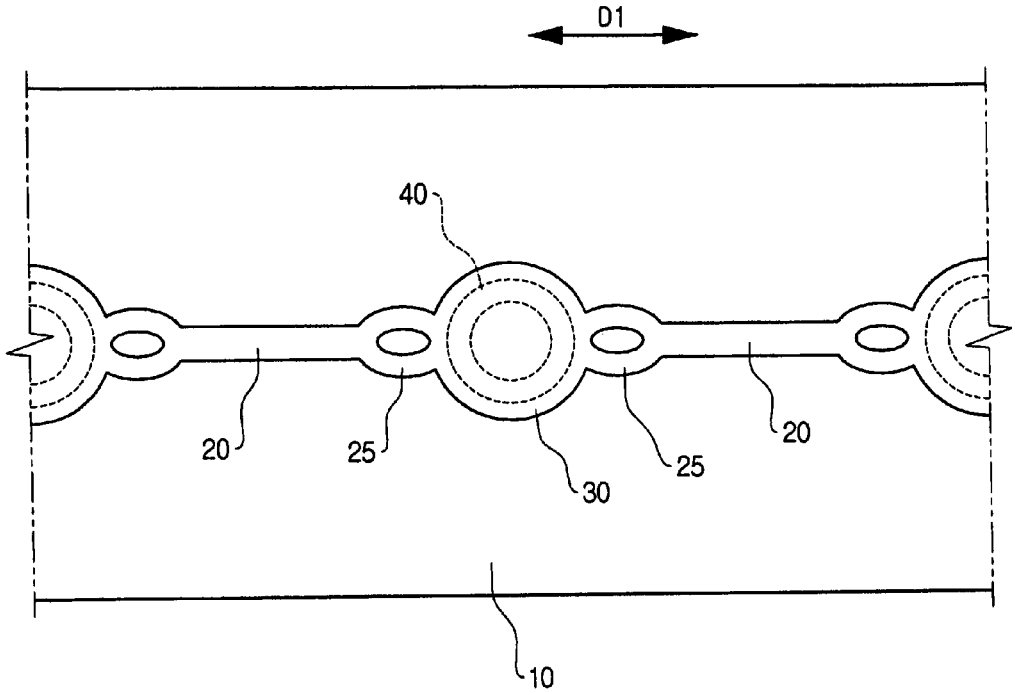
FIG. 4 is a plan view showing the deformation of the micro-heater of FIG. 1 when the micro-heater is cooled.

On the other hand, FIG. 4 is a plan view showing the deformation of the micro-heater of FIG. 1 when the micro-heater is cooled. When the micro-heater 50 is cooled, the length of the metal line 20 may be reduced. As the length of the metal line 20 is reduced, the deforming portion 25 may be stretched in the linear direction D1 and deformed into an elliptic shape having a major axis parallel to the direction D1. Accordingly, the tensile stress experienced by the metal line 20 may be decreased, and the possibility of breakage of the metal line 20 may be reduced or prevented.

As described above with reference to FIGS. 3 and 4, the micro-heater 50 according to example embodiments may have a deforming portion 25 that absorbs the tensile stress associated with the change in length of the metal line 20. Accordingly, the possibility of breakage of the metal line 20 may be reduced or prevented despite the re-crystallization of the materials during heating.

Although the deforming portion 25 is illustrated in FIG. 1 as having a circular shape with a hollow, open center, the deforming portion 25 may resemble other suitable shapes (e.g., polygon). For example, the deforming portion 25 may have a flat plate shape with a hollow center (e.g., a closed surface shape with a hollow center). The deforming portion 25 may also have an elliptical shape with a hollow, open center, wherein the major axis of the elliptical shape may be perpendicular to the linear direction D1 of the metal line 20.

Figure 5:
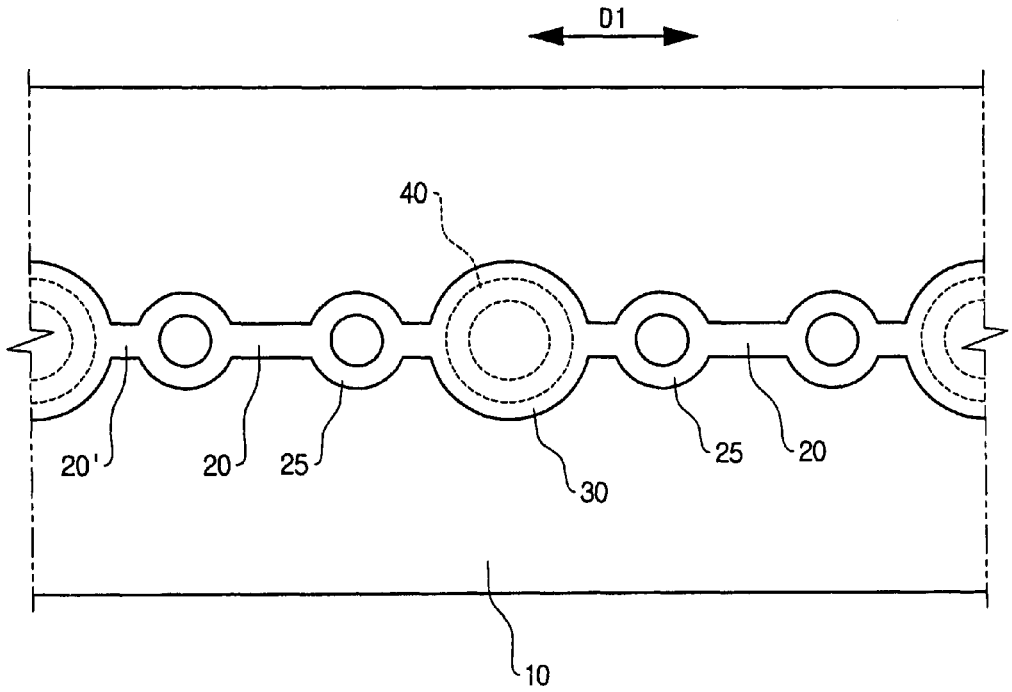
FIG. 5 is a plan view of another micro-heater according to example embodiments.

FIG. 5 is a plan view of another micro-heater according to example embodiments. The common features of FIG. 5 that were already previously discussed with regard to FIGS. 1-4 will not be repeated for purposes of brevity. Referring to FIG. 5, the deforming portions 25 may be formed so as to be spaced apart from the connecting portion 30 of the metal line 20 by a predetermined distance. The distance between the connecting portion 30 and an adjacent deforming portion 25 may be shorter than the distance between adjacent deforming portions 25.

Figure 6:
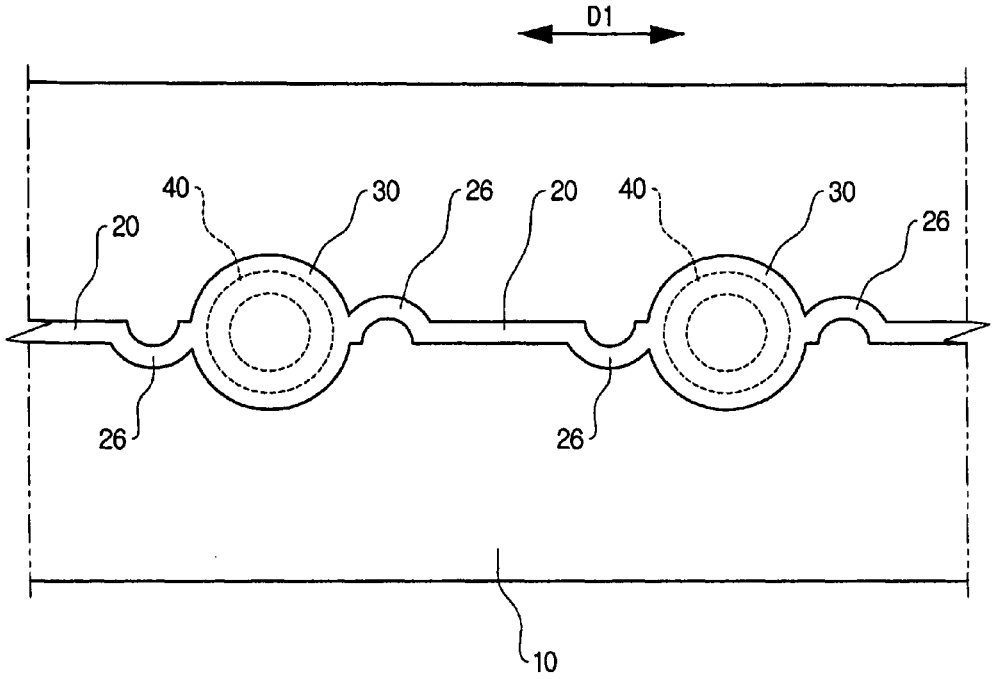
FIG. 6 is a plan view of another micro-heater according to example embodiments.

FIG. 6 is a plan view of another micro-heater according to example embodiments. The common features of FIG. 6 that were already previously discussed with regard to FIGS. 1-5 will not be repeated for purposes of brevity. Referring to FIG. 6, a deforming portion 26 may be integrally formed as part of the metal line 20. The deforming portion 26 may be formed in a curvilinear shape (e.g., semicircular shape). When the semicircular deforming portion 26 is deformed in response to the expansion/compression of the metal line 20, the tensile stress experienced by the metal line 20 may be decreased.

The two deforming portions 26 connected to opposite sides of the connecting portion 30 may be semicircular shapes formed so as to face in different directions. Alternatively, the deforming portions 26 may be curvilinear shapes connected to the connecting portion 30 so as to face in the same direction.

Although the deforming portion 26 of FIG. 6 is shown to have a semicircular shape, it should be understood that the deforming portion 26 may have other suitable shapes. Thus, the deforming portion 26 may be formed as another curved shape that is deformable by expansion and compression (e.g., a semi-elliptical shape). For semi-elliptical shapes, the major axis may be perpendicular to the longitudinal axis of the metal line 20. Alternatively, the deforming portion 26 may have a broken line shape (e.g., V-shape, zigzag shape).

Figure 7:
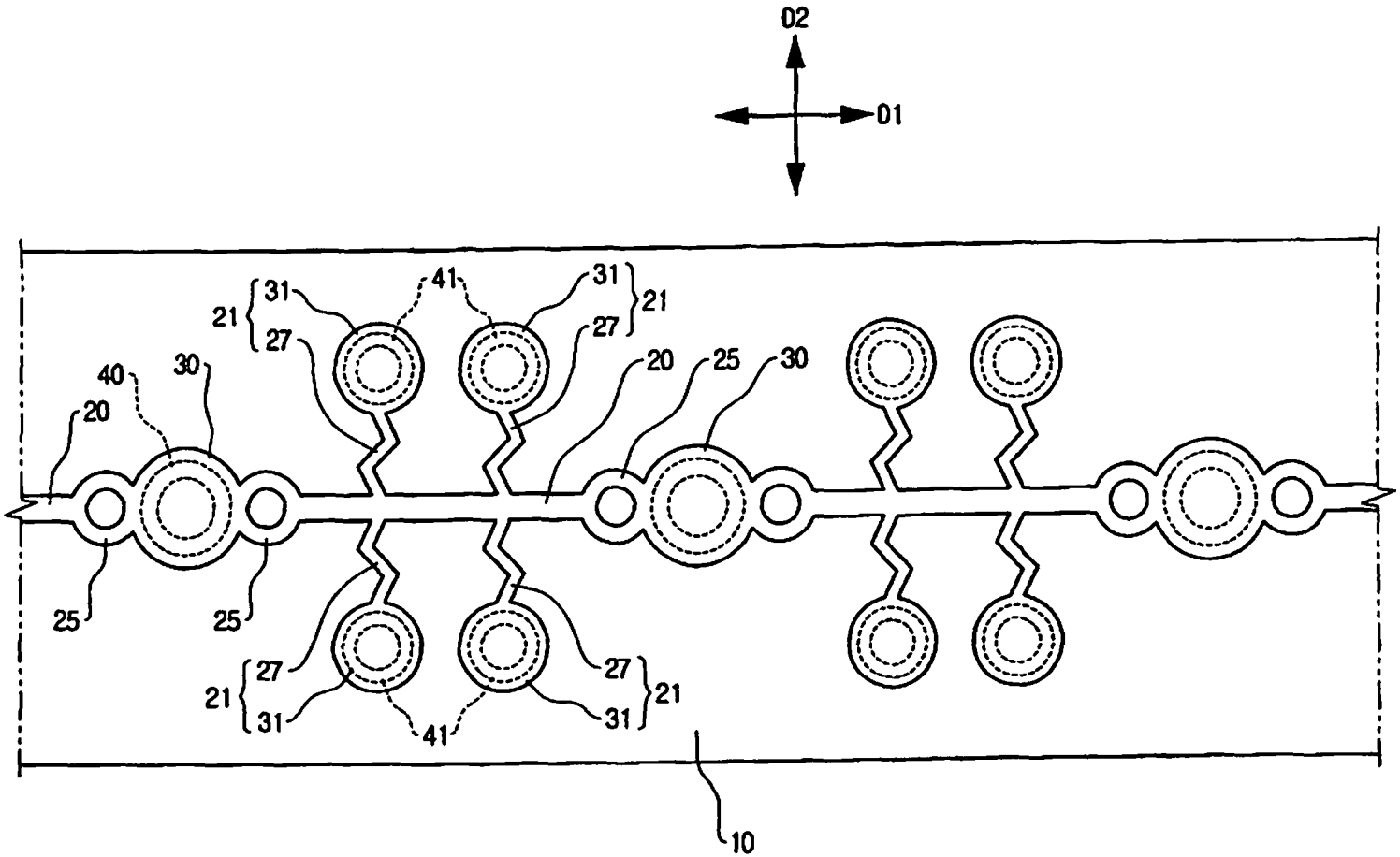
FIG. 7 is a plan view of another micro-heater according to example embodiments.

FIG. 7 is a plan view of another micro-heater according to example embodiments. The common features of FIG. 7 that were already previously discussed with regard to FIGS. 1-6 will not be repeated for purposes of brevity. Referring to FIG. 7, the micro-heater may include secondary metal lines 21 extending from both sides of the primary metal line 20. The primary metal line 20 may extend in a first direction D1, while the secondary metal lines 21 may extend in a second direction D2, the first direction D1 being distinct from the second direction D2.

A secondary deforming portion 27 may be integrally formed as part of the secondary metal line 21. The secondary deforming portion 27 may be connected to the primary metal line 20 and deformed in response to the expansion or compression of the primary metal line 20 and/or the secondary metal line 21 from the heating or cooling of the micro-heater.

Although the secondary metal lines 21 are illustrated in FIG. 7 as extending in a second direction D2 which is perpendicular to the first direction D1, it should be understood that other configurations are possible. For instance, one or more of the secondary metal lines 21 may extend in a second direction D2 that is inclined relative to the first direction D1. The secondary deforming portions 27 may be symmetrically arranged about the primary metal line 20. On the other hand, the secondary deforming portions 27 may be alternately arranged about the primary metal line 20.

A secondary support 41 may be positioned between the substrate 10 and the secondary connecting portion 31 of the secondary metal line 21. The secondary support 41 may support and connect the secondary metal line 21 to the substrate 10.

The secondary deforming portions 27 may have a broken line (e.g., zigzag) shape. As a result, when the primary metal line 20 and/or secondary metal line 21 is expanded or compressed, the angle of the broken line shape of the secondary deforming portions 27 may change to accommodate the expansion or compression.

It should be understood that the shape of the secondary deforming portion 27 in FIG. 7 is provided only for illustrative purposes. Thus, the secondary deforming portion 27 may be formed in other shapes that are deformable by expansion or compression. For example, the secondary deforming portion 27 may have a flat plate with a hollow, open center or a curvilinear shape.

Figure 8:
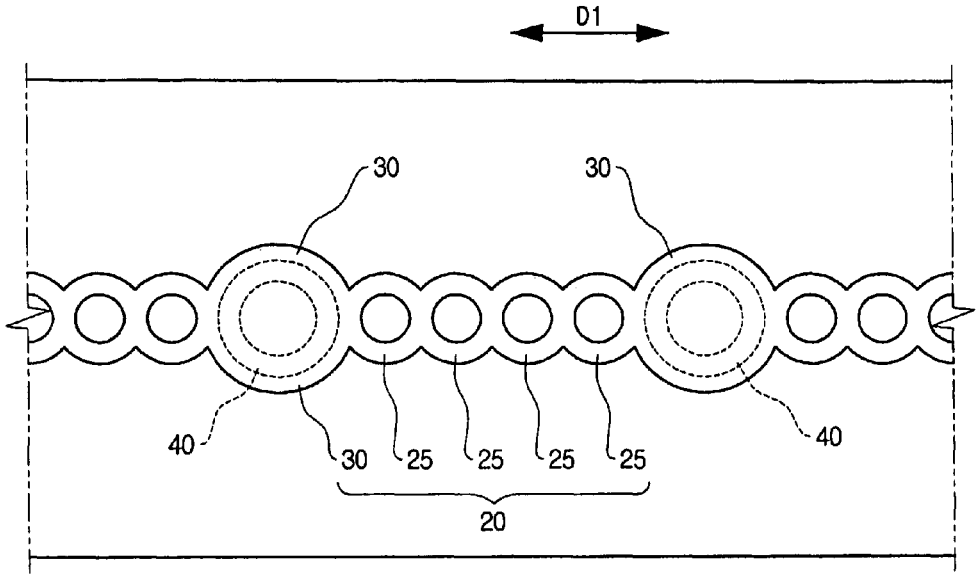
FIG. 8 is a plan view of another micro-heater according to example embodiments.

FIG. 8 is a plan view of another micro-heater according to example embodiments. Referring to FIG. 8, the micro-heater may include a metal line 20 and a support 40. The metal line 20 may include deforming portions 25 and connecting portions 30. The metal line 20 may be connected to the support 40 through the connecting portions 30. The parts of the metal line 20 other than the connecting portions 30 may be formed of one or more deforming portions 25 that are directly connected to one another. As previously noted, the deforming portions 25 may reduce or prevent the possibility of breakage of the metal line 20 during the expansion or compression caused by the heating or cooling of the micro-heater.

It should be understood that the deforming portions 25 of FIG. 8 are merely provided for illustrative purposes. Thus, the deforming portions 25 may have other suitable shapes. For example, the deforming portion 25 may have a flat plate shape with a hollow, open center, a curvilinear shape, or a broken line shape. Alternatively, the micro-heater may include a combination of the various shapes of the aforementioned deforming portions 25, 26, and/or 27. For example, a portion of the metal line may be formed of deforming portions having a flat plate shape with a hollow, open center, a curvilinear shape, and/or a broken line shape.

Figure 9:
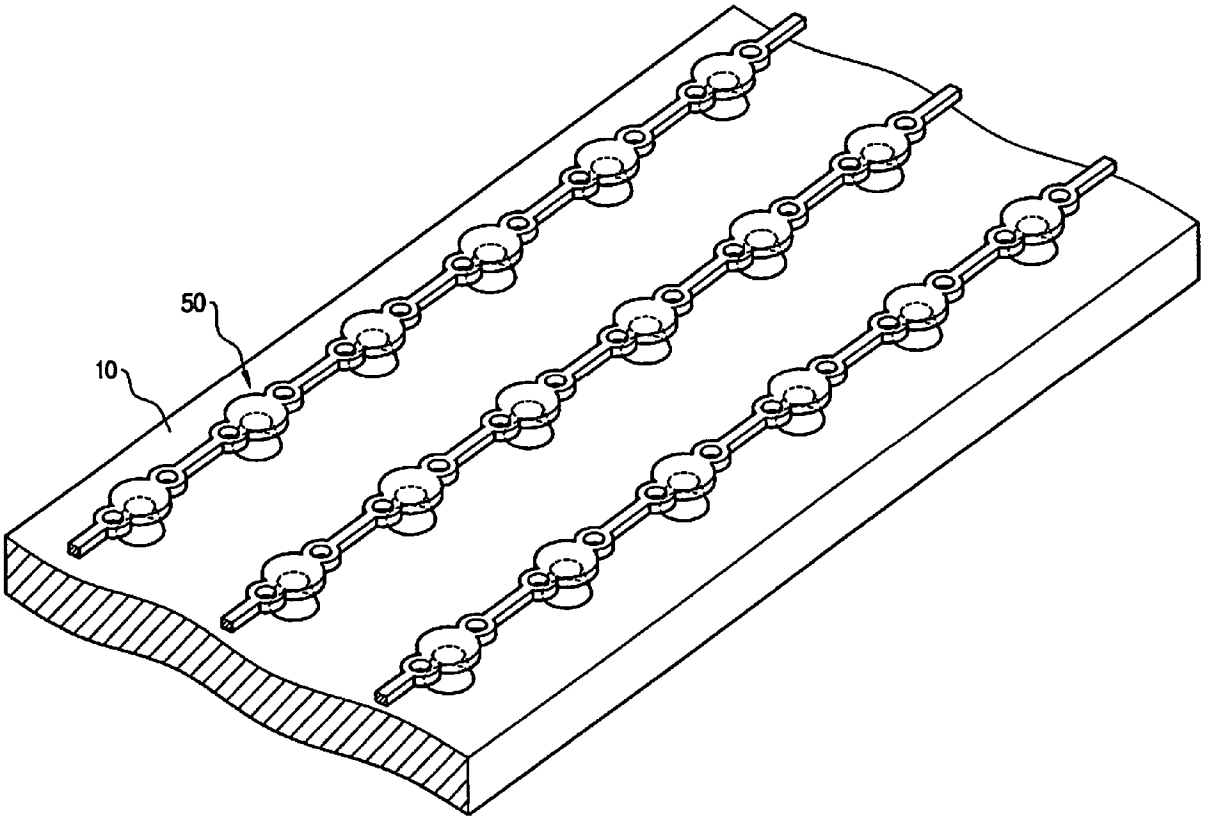
FIG. 9 is a perspective view of a micro-heater array according to example embodiments.

FIG. 9 is a perspective view of a micro-heater array according to example embodiments. Referring to FIG. 9, a micro-heater array may be formed by arranging two or more micro-heaters 50 in parallel on a substrate 10. The two or more micro-heaters 50 may also be connected in parallel so that the same voltage may be applied thereto. Although FIG. 9 shows a micro-heater array formed using the micro-heater 50 of FIG. 1, it should be understood that the depiction is merely provided for illustrative purposes. Thus, a micro-heater array may be formed using a variety of other micro-heaters akin to those previously discussed herein.

The micro-heater 50 or micro-heater array may be applied to various types of electronic devices which require a relatively high temperature manufacturing process or a relatively high temperature operating process. Examples of such electronic devices may include a carbon nanotube transistor, a low-temperature polycrystalline silicon or thin film transistor, and a TE field emission source for a backlight unit.

Because the metal line (which serves as the heating element) is spaced apart from the substrate 10, the micro-heater 50 may be less influenced by the design parameters of an electronic device (e.g., thin film transistor) when the micro-heater 50 or the micro-heater array is utilized. Therefore, when the micro-heater 50 is applied to an electronic device, the beneficial configurations of the micro-heater 50 may be used as they are. Furthermore, because the micro-heater 50 is less likely to be broken during heating and cooling, the stability and reliability of electronic devices may be improved.

Figure 10A:
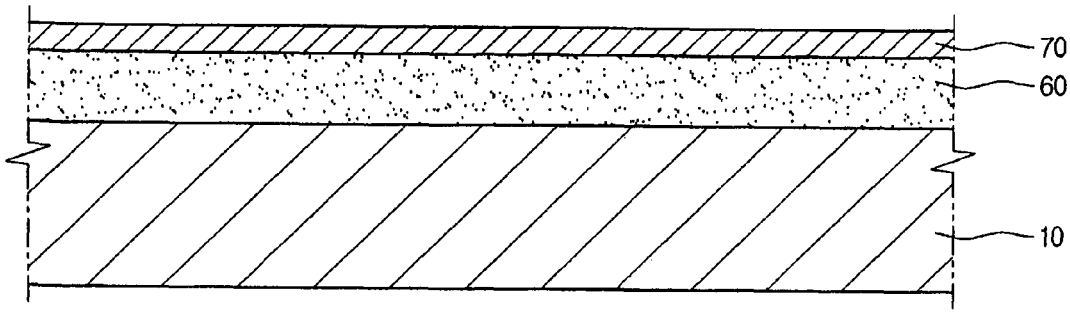
Figure 10B:
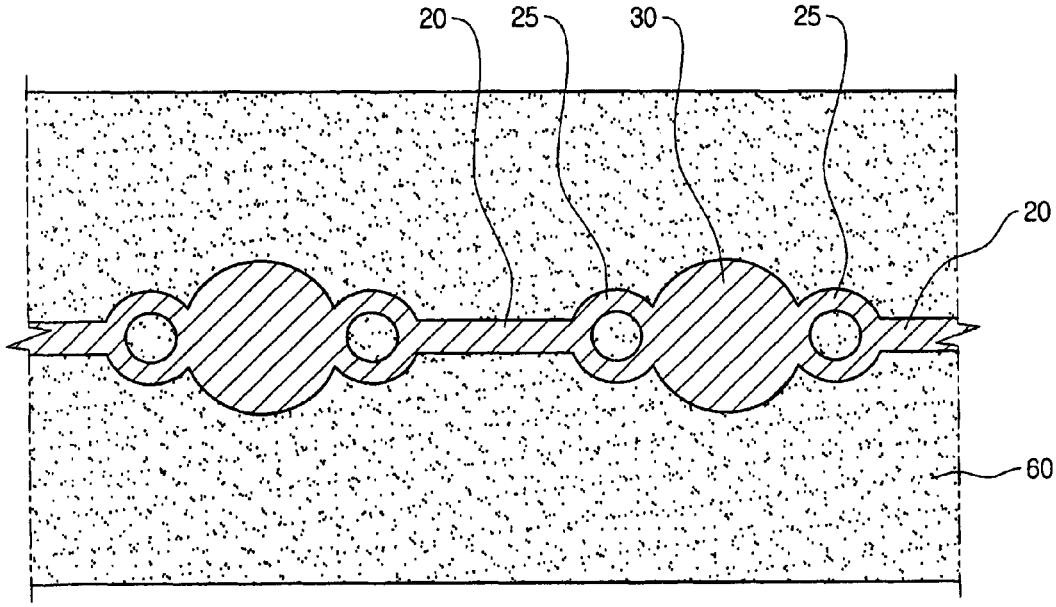
Figure 10C:
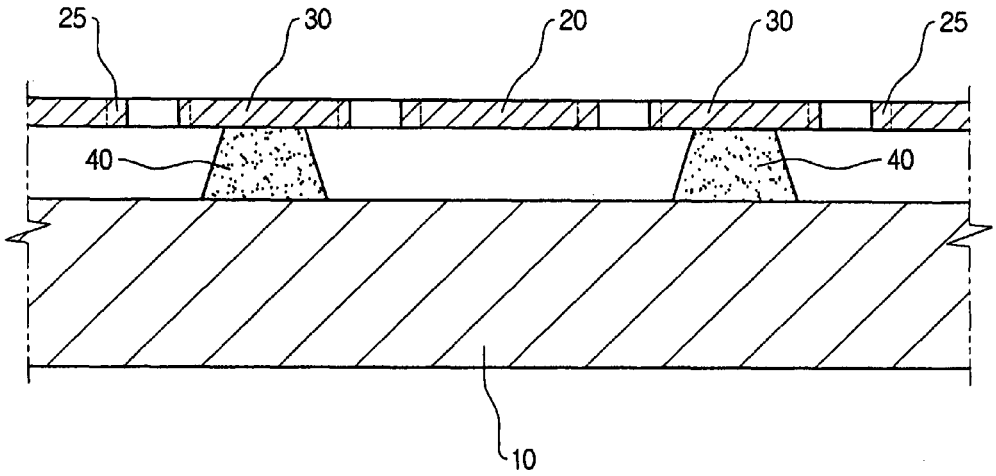

FIGS. 10A to 10C are views of a method of manufacturing a micro-heater according to example embodiments, wherein FIGS. 10A and 10C are cross-sectional views, and FIG. 10B is a plan view. Referring to FIG. 10A, a sacrificial layer 60 may be formed on a substrate 10. The sacrificial layer 60 may be etched to form a support 40 in a subsequent process. A heating layer 70 may be formed on the sacrificial layer 60. The sacrificial layer 60 may include silicon oxide ($SiO_x$) or another suitable oxide. The heating layer 70 may be formed of molybdenum (Mo), tungsten (W), silicon carbide, or other suitable materials.

Referring to FIG. 10B, the heating layer 70 may be patterned in the shape of a metal line 20. The metal line 20 may extend in a linear direction on the substrate 10. A deforming portion 25 and a connecting portion 30 may be integrally formed as part of the metal line 20. For example, the heating layer 70 may be patterned to form the metal line of FIG. 1. However, it should be understood that the heating layer 70 may be patterned in the shape of other metal lines according to example embodiments.

Referring to FIG. 10C, the sacrificial layer 60 may be etched to form a support 40. The support 40 may be formed beneath the connecting portion 30 of the metal line 20. The support 40 may secure the metal line 20 to the substrate 10, while also spacing the metal line 20 apart from the substrate 10.

When the metal line 20 is expanded or compressed as a result of heat, the deforming portion 25 of the metal line 20 may be deformed. Therefore, the tensile stress applied to the metal line 20 may be decreased. The deforming portion 25 may have a flat plate shape with a hollow and open center (e.g., ring shape), a curvilinear shape (e.g., semicircular shape), a broken line shape (e.g., zigzag shape), or other suitable shape that is conducive to deformation.

While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

What is claimed is:

1. A micro-heater comprising:

a primary metal line on a substrate, the primary metal line having a primary linear portion, a primary deforming portion, and a primary connecting portion integrally formed as a part of the primary metal line, the primary deforming portion having a structure that departs from and does not coincide with a longitudinal axis of the primary linear portion of the primary metal line, the primary connecting portion having a bottom surface; and a primary support between the primary connecting portion of the primary metal line and the substrate, the primary support separating the primary metal line from the substrate while securing the primary metal line to the substrate, the primary support having a top surface that interfaces with the bottom surface of the primary connecting portion, the bottom surface of the primary connecting portion being larger than the top surface of the primary support.

2. The micro-heater according to claim 1, wherein the primary deforming portion deforms in response to an expansion or compression of the primary metal line.

3. The micro-heater according to claim 1, wherein the primary deforming portion adjoins the primary connecting portion.

4. The micro-heater according to claim 1, wherein the primary deforming portion is spaced apart from the primary connecting portion.

5. The micro-heater according to claim 1, wherein the primary deforming portion has a flat upper surface and a hollow center.

6. The micro-heater according to claim 5, wherein the primary deforming portion has an open center.

7. The micro-heater according to claim 6, wherein the primary deforming portion has a circular shape or an elliptical shape.

8. The micro-heater according to claim 7, wherein a major axis of the elliptical shape is perpendicular to the longitudinal axis of the primary metal line.

9. The micro-heater according to claim 1, wherein the primary deforming portion has a curvilinear shape or a zigzag shape.

10. The micro-heater according to claim 9, wherein the curvilinear shape is a semicircular shape or a semi-elliptical shape.

11. The micro-heater according to claim 10, wherein a major axis of the semi-elliptical shape is perpendicular to the longitudinal axis of the primary metal line.

12. The micro-heater according to claim 1, wherein the primary metal line includes one or more of molybdenum, tungsten, and silicon carbide.

13. The micro-heater according to claim 1, wherein the primary support includes silicon oxide.

14. The micro-heater according to claim 1, further comprising:

a secondary metal line on the substrate and extending from a side of the primary metal line, the secondary metal line having a secondary linear portion, a secondary deforming portion, and a secondary connecting portion integrally formed as a part of the secondary metal line, the secondary deforming portion having a structure that departs from and does not coincide with a longitudinal axis of the secondary linear portion of the secondary metal line; and a secondary support between the secondary connecting portion of the secondary metal line and the substrate, the secondary support separating the secondary metal line from the substrate while securing the secondary metal line to the substrate.

15. An electronic device comprising the micro-heater of claim 1.

16. A micro-heater array comprising two or more micro-heaters of claim 1 arranged in parallel.

17. An electronic device comprising the micro-heater array of claim 16.

18. The micro-heater according to claim 1, wherein the primary deforming portion is a ring-shaped body that defines a hole extending through the body thereof.

19. The micro-heater according to claim 1, wherein the primary metal line includes ends that coincide with the longitudinal axis of the primary linear portion.

20. The micro-heater according to claim 1, wherein the bottom surface of the primary connecting portion completely covers the top surface of the primary support.

* * * * *